US011008829B2

(12) United States Patent
Saraya et al.

(10) Patent No.: US 11,008,829 B2
(45) Date of Patent: May 18, 2021

(54) METHODS AND SYSTEMS FOR A TOE SLEEVE

(71) Applicant: Vertice Oil Tools, Missouri City, TX (US)

(72) Inventors: Mohamed Ibrahim Saraya, Sugar Land, TX (US); Stephen Parks, Houston, TX (US); Andrew John Webber, Missouri City, TX (US)

(73) Assignee: VERTICE OIL TOOLS INC, Missouri City, TX (US)

( * ) Notice: Subject to any disclaimer, the term of this patent is extended or adjusted under 35 U.S.C. 154(b) by 0 days.

(21) Appl. No.: 16/690,967

(22) Filed: Nov. 21, 2019

(65) Prior Publication Data

US 2020/0190940 A1 Jun. 18, 2020

Related U.S. Application Data

(60) Provisional application No. 62/780,370, filed on Dec. 17, 2018.

(51) Int. Cl.
*E21B 34/06* (2006.01)
*E21B 34/10* (2006.01)

(52) U.S. Cl.
CPC ..... *E21B 34/063* (2013.01); *E21B 34/102* (2013.01); *E21B 2200/06* (2020.05)

(58) Field of Classification Search
CPC ..... E21B 34/063; E21B 34/08; E21B 34/102; E21B 2200/06; E21B 33/00
See application file for complete search history.

(56) References Cited

U.S. PATENT DOCUMENTS

| | | | | |
|---|---|---|---|---|
| 4,991,654 | A * | 2/1991 | Brandell | E21B 23/006 166/240 |
| 9,574,421 | B1 * | 2/2017 | Saraya | E21B 34/142 |
| 2015/0000920 | A1 * | 1/2015 | Harris | E21B 23/004 166/308.1 |

* cited by examiner

*Primary Examiner* — Cathleen R Hutchins
(74) *Attorney, Agent, or Firm* — Pierson IP, PLLC

(57) ABSTRACT

A toe sleeve that is configured to allow communication between an inner diameter of the tool and an annulus outside of the tool during a bleed off cycle, which occurs after testing the casing. To test the casing, pressure within the inner diameter of the tool may be increased, and during a bleed off cycle the pressure within the inner diameter of the tool may be reduced.

20 Claims, 14 Drawing Sheets

METHODS AND SYSTEMS FOR A TOE SLEEVE

BACKGROUND INFORMATION

Field of the Disclosure

Examples of the present disclosure relate to toe sleeve, wherein the toe sleeve includes a mechanically driven piston with a force generating device and a rupture disc.

Background

Hydraulic fracturing is the process of creating cracks or fractures in underground geological formations. After creating the cracks or fractures, a mixture of water, sand, and other chemical additives are pumped into the cracks or fractures to protect the integrity of the geological formation and enhance production of the natural resources. The cracks or fractures are maintained opened by the mixture, allowing the natural resources within the geological formation to flow into a wellbore, where it is collected at the surface.

Before the cracks or fractures in the underground formations are created, cement is pumped through casing in order to cement the casing into the wellbore. After cementing, a conduit between the wellbore and the formation must be created/re-opened in order to communication for stimulation and production be achieved. However, It is typically desirable to pressure test the casing prior to creating this conduit. Conventionally, to limit initial communication and allow testing, a toe sleeve with rupture disc is used. However, the rupture discs typically burst before a pressure level required to test the casing. Also, conventional rupture discs only allow for a single pressure cycle. Yet, if leaks are detected during the casing test pressure and the rupture disc breaks, there are no other means to test the casing for leak point identification.

Accordingly, needs exist for system and methods for a toe sleeve that is configured to allow communication during a bleed off cycle or allow for multiple testing cycles.

SUMMARY

Embodiments disclosed herein describe a downhole tool, such as a toe sleeve, that is configured to allow communication between an inner diameter of the tool and an annulus outside of the tool during a bleed off cycle, which occurs after testing the casing. In embodiments, to test the casing, pressure within the inner diameter of the tool may be increased, and during the bleed off cycle the pressure within the inner diameter of the tool may be reduced.

The tool may include an outer sidewall with a recess, locking joints, and a port. The tool may also include a sliding sleeve positioned within the outer sidewall, and a force generating device positioned between the outer sidewall and the sliding sleeve.

The recess may be an indentation, groove, etc. within an inner circumference of the outer sidewall. The recess may be configured to increase an inner diameter within the outer sidewall. The increase of size of the inner diameter may create a piston area configured to allow the sliding sleeve to move in a first direction within the outer sidewall.

The locking joint may be positioned within the piston area, and be an abutment, outcrop, projection, etc. configured to limit the movement of the sliding sleeve within the outer sidewall.

The external port may be a hole, passageway, etc. positioned through the outer sidewall. The port may be configured to allow communication between an area outside of the outer sidewall and an area within the inner diameter of the tool.

The sliding sleeve may be an inner sleeve configured to move in a first direction and/or a second direction within the tool. The sliding sleeve may be configured to move in a first direction responsive to fluid flowing through the inner diameter of the tool being greater than a pressure threshold, wherein the pressure threshold is associated with a force generated by the force generating member. The sliding sleeve may include an upper piston area, rupture disc, and pressure equalizing hole.

The upper piston area may be positioned on a proximal end of the sliding sleeve and may have a larger inner diameter than a lower piston area positioned on a distal end of the sliding sleeve. Due to the difference in sizes of the upper piston area and the lower piston area, the sliding sleeve may be configured to generate sufficient force to move in a first direction within the outer sidewall. The upper piston area may also be configured to interface with the locking joint to limit the movement of the sliding sleeve in the first direction.

The rupture disc may be a removable component that is positioned within a disc port positioned through the sliding sleeve. The rupture disc may be configured to rupture, break, fragment, dissolve, be removable, etc. by applying a predetermined pressure across the rupture disc when the rupture disc is aligned with the external port.

The pressure equalizing hole may be extended through the sliding sleeve, and may be configured to balance a pressure across the rupture disc between a first surface of the rupture disc facing a central axis of the tool and a second surface of the rupture disc facing an inner diameter of the outer sidewall. The pressure equalizing hole may also be configured to reduce, dampen, etc. a speed of movement of the sliding sleeve in a second direction responsive to reducing pressure within the tool.

The force generating device may be a device that is configured to apply an axial force against the sliding sleeve in a second direction, wherein the second direction is an opposite direction than the first direction. The force generating device may be a spring, hydraulic chamber, mechanical membrane, etc. The force generating device may be set such that when the force generating device is compressed then the rupture disc is misaligned with the external port, and when the force generating device is elongated then the rupture disc may be aligned with the external port.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
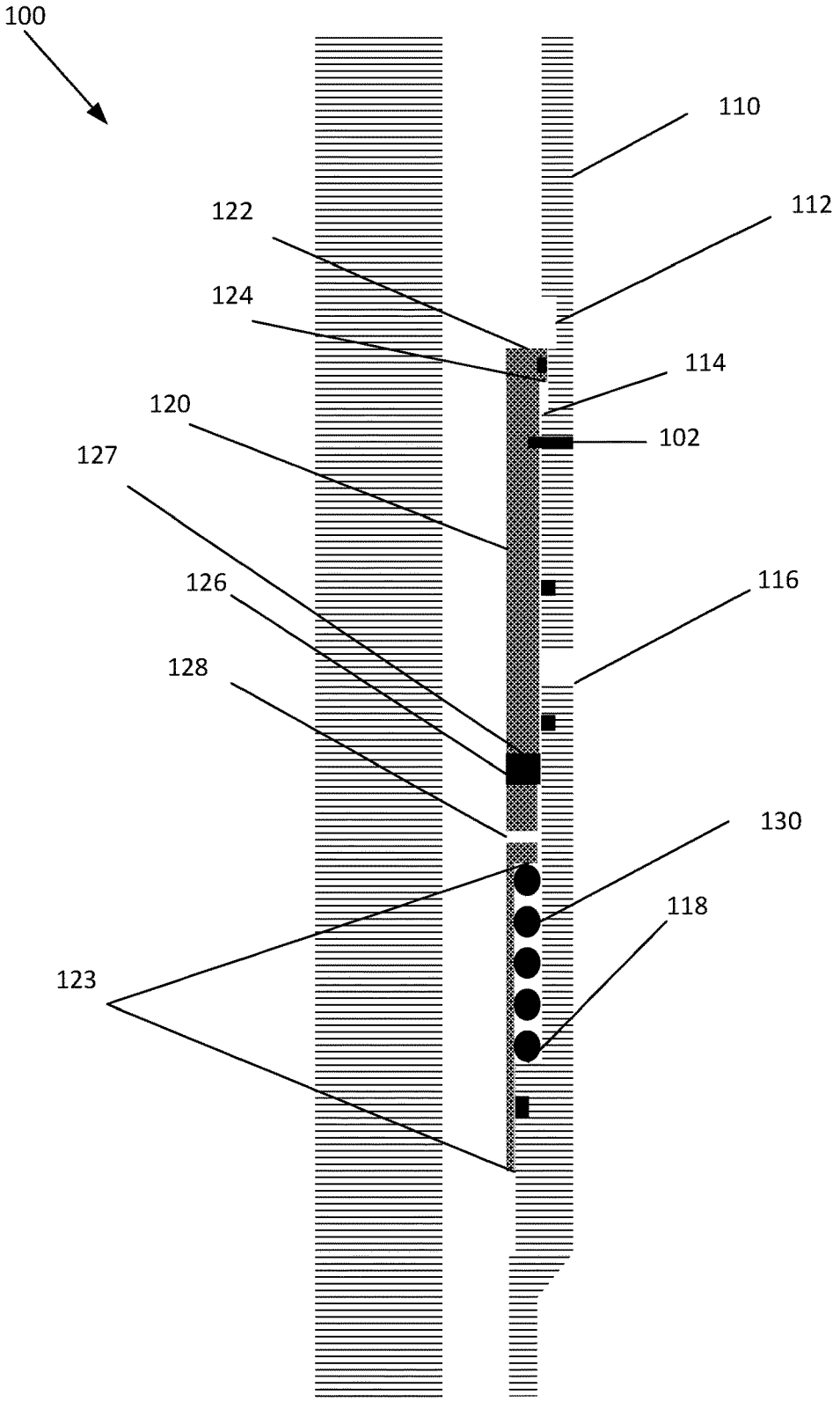
FIG. 1 depicts a downhole tool, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Turning now to FIG. 1, FIG. 1 depicts a downhole tool 100, according to an embodiment. In embodiments, a wellbore may include a plurality of downhole tools 100, which may be aligned across their central axis in parallel with one another. The plurality of downhole tools 100 may be aligned such that a first downhole tool 100 is positioned before a second downhole tool 100. Tool 100 may include an outer sidewall 110, sliding sleeve 120, and force generating device 130. In embodiments, outer sidewall 110 and sliding sleeve 120 may be coupled together via shear screws 102 or any other device that is configured to break responsive to an increase in pressure within tool 100. This may allow for sliding sleeve 120 to be temporarily coupled to outer sidewall 110 at a first location associated with shear screws 102. Responsive to shear screws 102 breaking, sliding sleeve 120 may move axially within tool 100.

Outer sidewall 110 may form a hollow chamber, channel, conduit, passageway, etc. across an inner diameter of outer sidewall 110. Positioned outside outer sidewall 110 may be an annulus between a geological formation and outer sidewall 110. The hollow chamber within outer sidewall 110 may extend form a top surface of outer sidewall 110 to a lower surface of outer sidewall 110. Outer sidewall 110 may include recess 112, locking joints 114, external port 116, and ledge 118.

Recess 112 may be an indentation groove, etc. within an inner circumference of outer sidewall 110 extending from the inner circumference of outer sidewall 110 towards the outer circumference of outer sidewall 110. Recess 112 may be configured to increase an inner diameter across the inner diameter of outer sidewall 110. Recess 112 may have a larger inner diameter than other areas associated with outer sidewall, except for external port 116. This may allow change in piston force created on elements aligned with recess 112. In embodiments, when tool is initially placed within a wellbore, recess 112 may be positioned closer to a proximal end of tool 100 than an upper surface of sliding sleeve 120, and the upper surface of sliding sleeve 120 may be aligned with a lower surface of recess 112.

Locking joints 114 may extend from recess 112 towards a central axis of tool 110, which may be utilized to limit the movement of sliding sleeve 120 in a first direction. Responsive to sliding sleeve 120 being positioned adjacent to locking joints 114, sliding sleeve 120 may no longer be able to move in the first direction towards a distal end of downhole tool 100. The locking joint 114 maybe a no go shoulder or any other profile that prevents sliding sleeve 120 from moving in the first direction.

External port 116 may be a hole, passageway, etc. positioned through outer sidewall 110 from the inner circumference of outer sidewall 110 to the outer circumference of outer sidewall 110. External port 116 may be configured to allow communication between the hollow chamber within tool 100 to an annulus outside of tool 100, i.e.: the geological formation.

Ledge 118 may be an outcrop, protrusion, etc. configured to extend towards a central axis of tool 100 from the inner circumference of outer sidewall 110. Ledge 118 may be configured to support a first end of force generating device 130.

Sliding sleeve 120 may be configured to be positioned within outer sidewall 110 and move in a first direction and a second direction based on a pressure within the hollow chamber and the force generated by force generating device 130. Sliding sleeve 120 may be configured to move in a first direction responsive to applied pressure through the inner diameter of the tool 100 creating a piston force on the sliding sleeve 120 that is greater than the force applied to sliding sleeve 120 by force generating device 130 in a second direction. Sliding sleeve 120 may include upper piston area 122, locking fingers 124, rupture disc 126, and pressure equalizing hole 128.

Upper piston area 122 may be positioned on a proximal end of sliding sleeve 120. Upper piston area 122 may have a larger diameter and occupy more surface area than a lower piston area 123 positioned on a distal end of sliding sleeve 120, wherein the lower piston area 123 may be comprised of more than one surface area, wherein the more than one surface area may be positioned at different offsets along a central axis of tool 110. A first surface of lower piston area 123 may be on the distal most area of sliding sleeve 120 and a second surface of lower piston area 123 may be the area that interacts with force generating device 130. By upper piston area 122 occupying a larger surface area than lower piston area 123, upper piston area 122 may be impacted greater than lower piston area 123 by a pressure within tool 100, which may assist in moving sliding sleeve 120 in a first direction and overcoming a force generated by force generating device 130. In implementations, before increasing a pressure within tool 100, upper piston area 122 may be aligned with a lower edge of recess 112.

Locking fingers 124 may be positioned on a lower edge of upper piston area 122. Locking fingers 124 may be configured to be positioned into a lower cavity within recess 112 and be positioned adjacent to locking joint 114. Responsive to positioning locking fingers 124 adjacent to or within locking joint 114, sliding sleeve 120 may not be able to move in the first direction after a certain pre-determined stoke length.

Rupture disc 126 may be positioned within an internal port 127, wherein internal port 127 extends through sliding sleeve 120. Rupture disc 126 may be configured to be removed, rupture, break, fragment, dissolve, etc. by applying a predetermined pressure across the rupture disc 126. In embodiments, rupture disc 126 may rupture when rupture disc 126 is aligned with external port 116 based on a pressure differential between a pressure within the hollow chamber in the tool 100 and a pressure in the annulus outside of the tool.

Pressure equalizing hole 128 may extend through sliding sleeve 120, and may be configured to balance a pressure across rupture disc 126 when internal port 127 is not aligned with external port 116. In embodiments, pressure equalizing hole 128 may be configured to allow a pressure on a first surface of rupture disc 126 to be substantially equal to the pressure on a second surface of rupture disc 126 when internal port 127 is misaligned with external port 116 due to a seal being positioned between the second face of rupture disc 126 and external port 116. Further, pressure equalizing hole 128 may allow the pressure on the first surface of rupture disc 126 to be different from the pressure on the second surface of rupture disc 126 when internal port 127 is aligned with external port 116. Additionally, pressure equalizing hole 128 may also be configured to equalize a pressure within a chamber housing force generating device 130 and across the inner diameter of tool 100. This may reduce, dampen, etc. a speed of movement of sliding sleeve 120 in a second direction when reducing pressure within tool 100.

Force generating device 130 may be a device that is configured to apply an axial force against the sliding sleeve 120 in a second direction, wherein the second direction is an opposite direction than the first direction. Force generating device 130 may be a spring, hydraulic pump, mechanical membrane, etc. Force generating device 130 may be set such that when the force generating device 130 is compressed, rupture disc 126 is misaligned with external port 116, and when the force generating device 130 is elongated then rupture disc 126 is aligned with external port 116. In embodiments, force generating device 130 may be configured to be compressed when run in hole, and when sliding sleeve 120 is coupled to outer sidewall 110 via shear screws 102. Responsive to sliding sleeve 120 being decoupled from outer sidewall 110, force generating device 130 may be elongated or further compressed.

Additionally, seals may be positioned between sliding sleeve 120 and outer sidewall 110. The seals may be configured to restrict communication across the seals. This may enable equalizing hole 116 to equalize the pressure across rupture disc 126 when rupture disc 126 is not positioned between the seals, and allow for a pressure differential across rupture disc 126 when rupture disc 126 is positioned between the seals.

Figure 2:
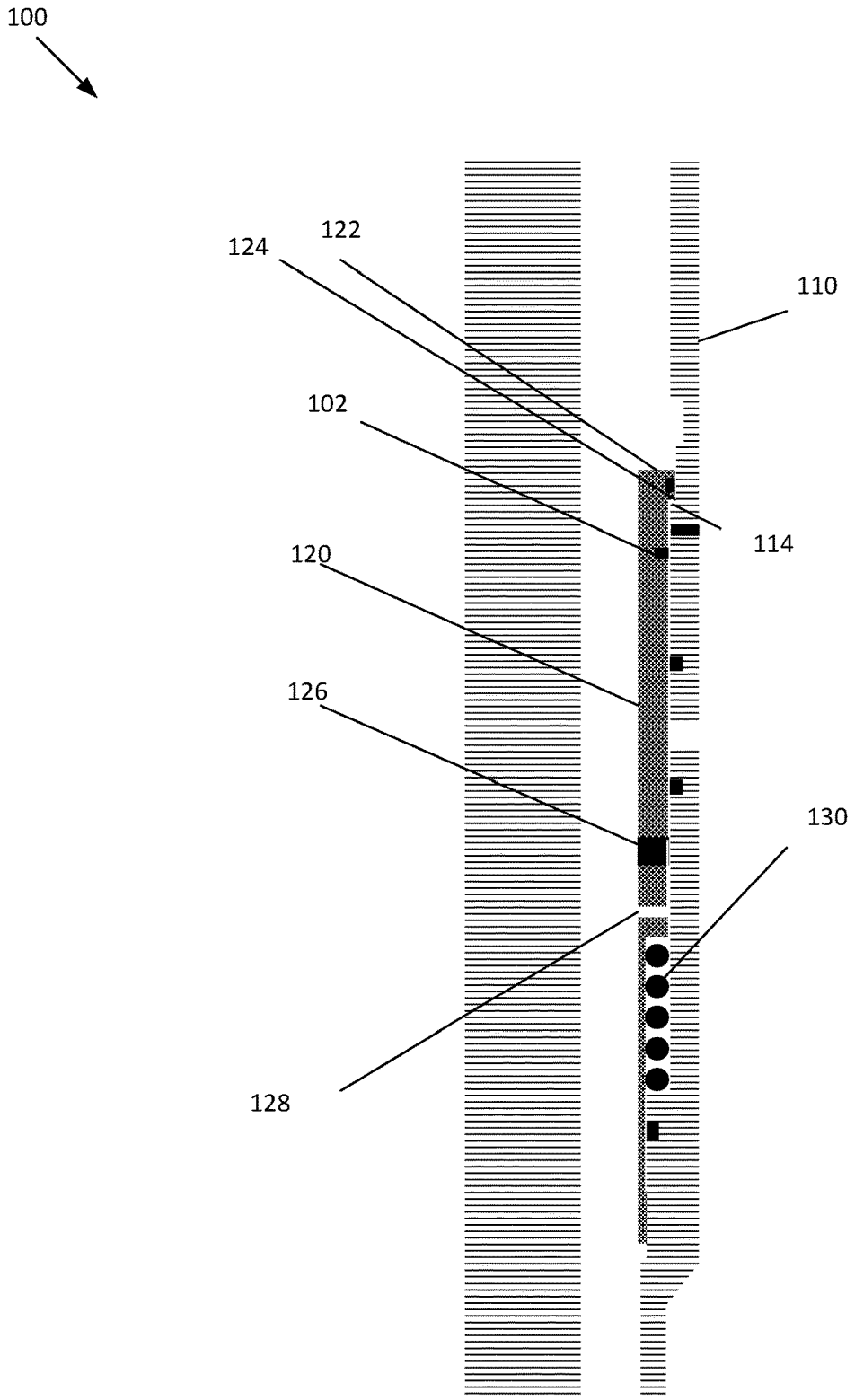
FIG. 2 depicts a downhole tool, according to an embodiment.

FIG. 2 depicts an embodiment responsive to a first test occurring and fluid is pumped within the inner diameter of tool 100 above a first pressure threshold. Elements depicted in FIG. 2 may be described above, and for the sake of brevity another description of these elements is omitted.

By pumping fluid within the inner diameter of the tool 100 above the first pressure threshold, shear screws 102 may break, allowing sliding sleeve 120 to move in the first direction.

As depicted in FIG. 2, responsive shear screws 102 breaking and increasing the pressure across upper piston area 122, sliding sleeve 120 may move in a first direction towards a distal end of tool 100. The movement of sliding sleeve 120 may be limited by locking fingers 124 interfacing with locking joint 114. Furthermore, responsive to moving sliding sleeve 120 in the first direction, force generating device 130 may compress.

Additionally, the pressure within a chamber housing force generating device 130 and the pressure across rupture disc 126 may be equalized via pressure equalizing hole 128 extending through sliding sleeve 120 into the chamber from the inner diameter of tool 100.

Figure 3:
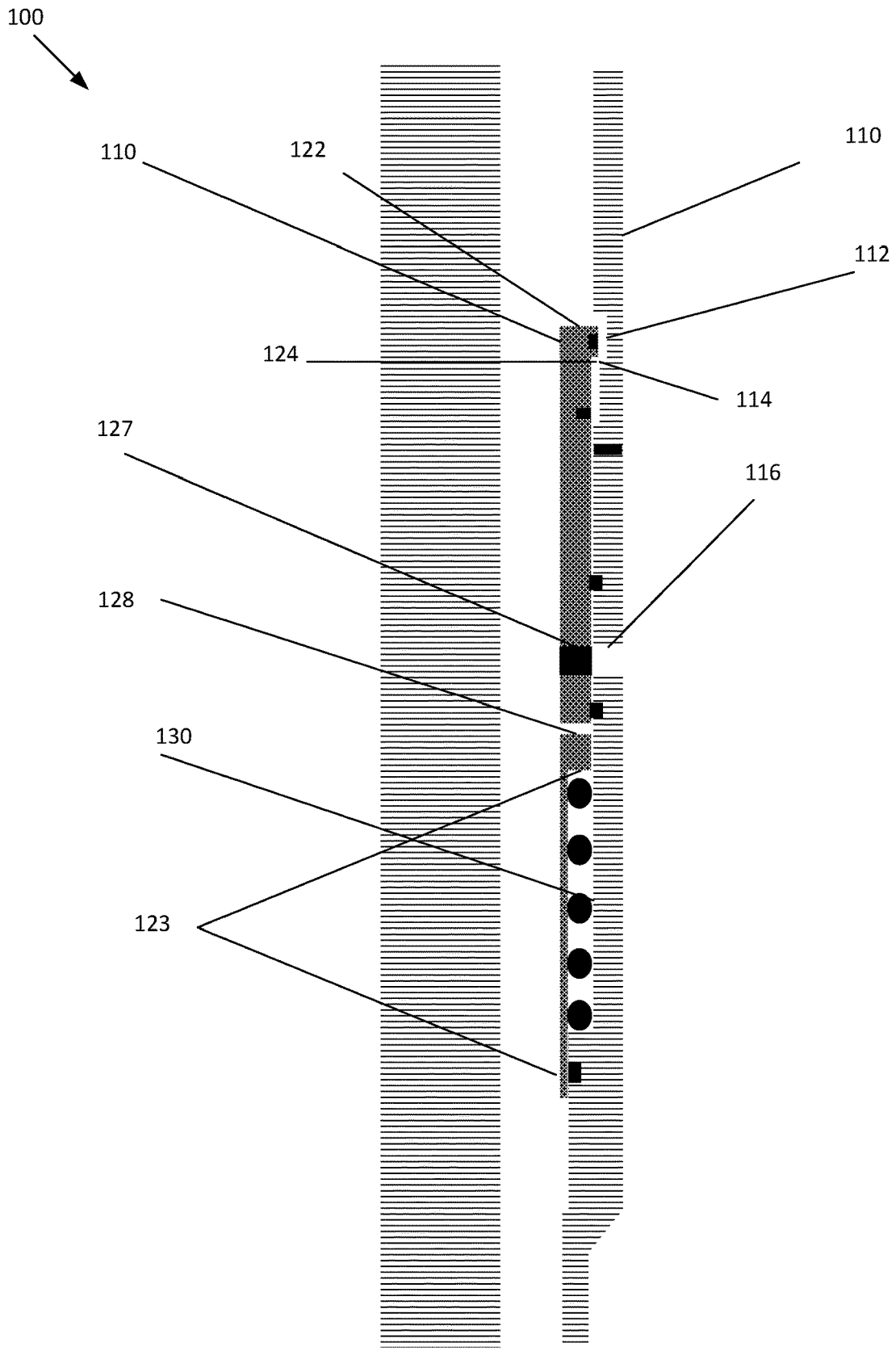
FIG. 3 depicts a downhole tool, according to an embodiment.

FIG. 3 depicts an embodiment of tool 100 responsive to decreasing the pressure across the inner diameter of tool 100. Elements depicted in FIG. 3 may be described above, and for the sake of brevity another description of these elements is omitted.

As depicted in FIG. 3, responsive to decreasing the pressure across inner diameter of tool 100, internal port 127 may become aligned with external port 116. This may be based on mechanical properties of force generating device 130 being configured have a resting state. In the resting state, force generating device 130 may be elongated to a distance to align internal port 127 with external port 116. Furthermore, the speed at which force generating device 130 transitions from a compressed state to an elongated state may be dampened based on pressure equalizing hole 128 equalizing a pressure within the inner diameter of tool 100 and a chamber housing force generating device 130.

When force generating device 130 is elongated, upper piston area 122 may be aligned with recess 112. This may eliminate the difference in piston areas 122 and 123 and allow the force generating device 130 to create a higher net positive force which help moving sliding sleeve 120 in the second direction.

Figure 4:
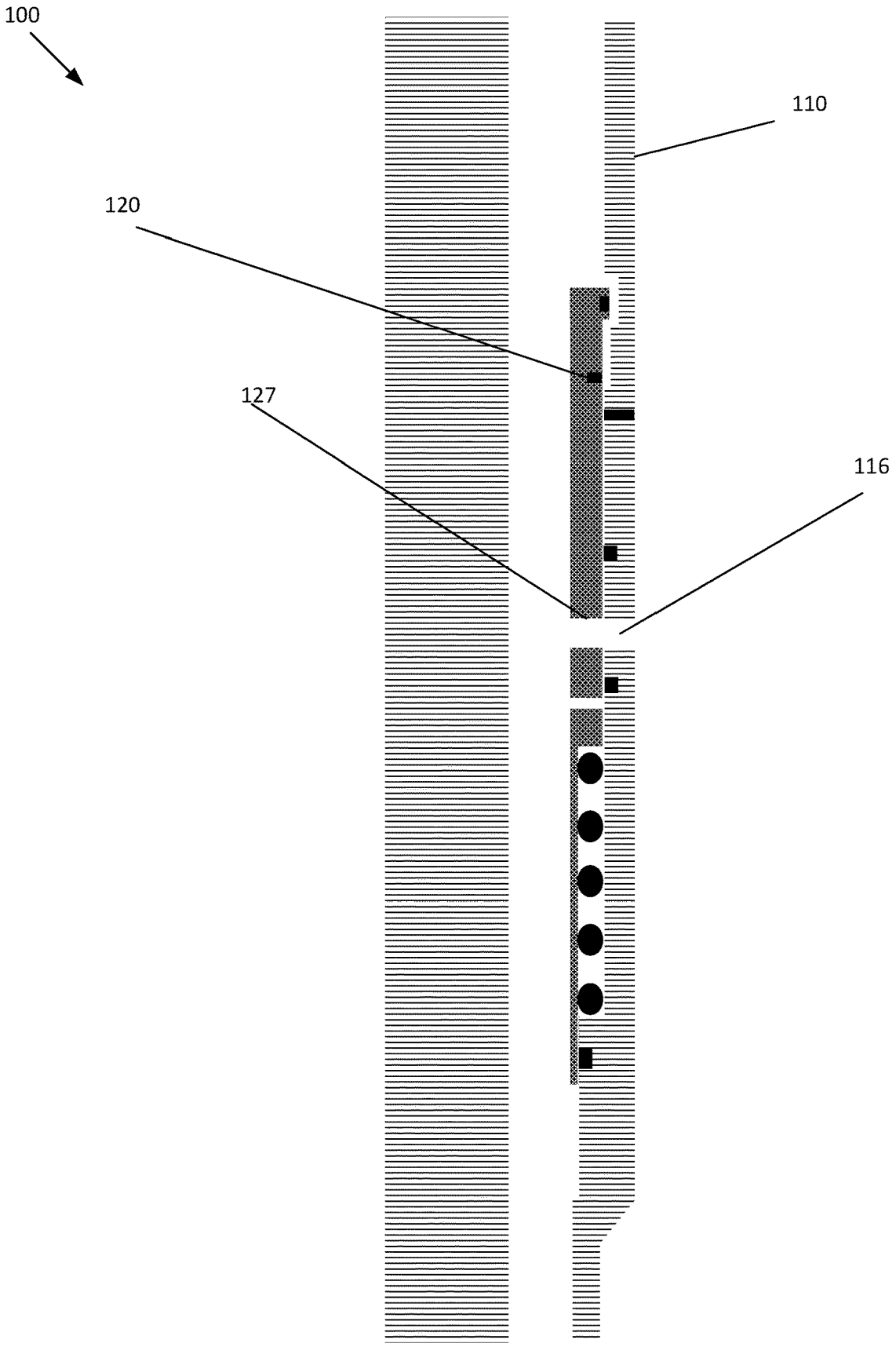
FIG. 4 depicts a downhole tool, according to an embodiment.

FIG. 4 depicts an embodiment of tool 100 responsive to decreasing the pressure across the inner diameter of tool 100. Elements depicted in FIG. 4 may be described above, and for the sake of brevity another description of these elements is omitted.

Responsive to aligning internal port 127 with external port 116, a pressure differential may be created across rupture disc 126. The pressure differential may be substantial enough to rupture and remove rupture disc 126 allowing communications from the annulus to the inner diameter of the tool 100.

Figure 5:
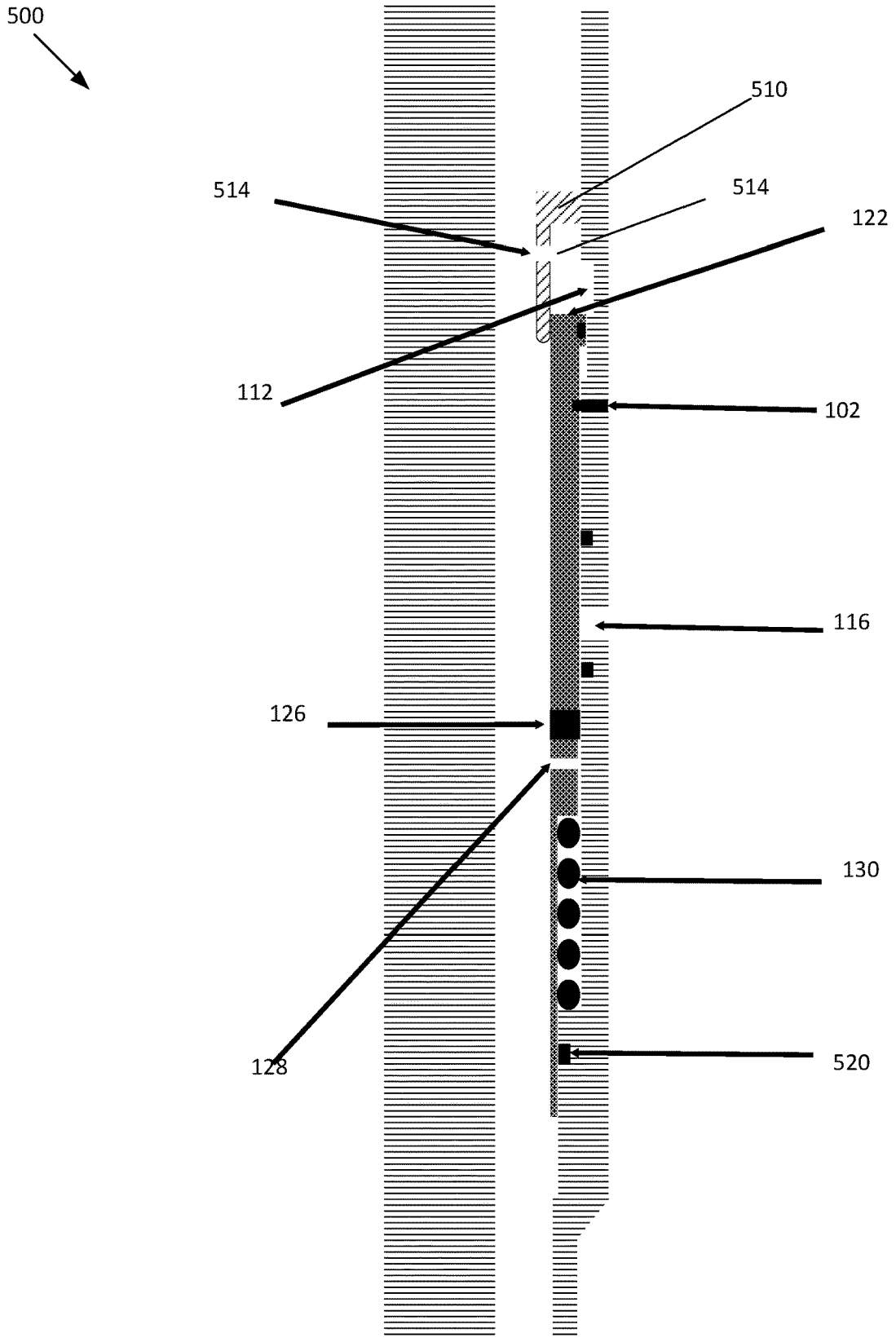
FIG. 5 depicts a downhole tool, according to an embodiment.

FIG. 5 depicts a tool 500, according to an embodiment. Elements depicted in FIG. 5 may be described above, and for the sake of brevity another description of these elements may be omitted.

FIG. 5 may include a metering device 510. Metering device 510 may be configured to create a chamber 512 above a proximal end of sliding sleeve 120 and recess 122. Metering device 510 may have a passageway 514 that is configured to extend from the inner diameter of tool 100 to chamber 512. This may allow pressure within chamber 512 to impact upper piston area 122 via recess 112 to move sliding sleeve 120. Furthermore, metering device 510 may be configured to limit, reduce, dampen, the movement of sliding sleeve 120 in either the first direction or the second direction based on pressure within inner diameter of tool 100, the distance across passageway 514, and the diameter of the inner diameter of tool 100.

Embodiments may also include a seal 520, barrier, etc. Seal 520 may be configured to limit communication between the inner diameter of the tool 100 and the chamber housing force generating device 130 except for through pressure equalizing hole 128. Seal 520 may also be configured to limit debris from entering the chamber.

Figure 6:
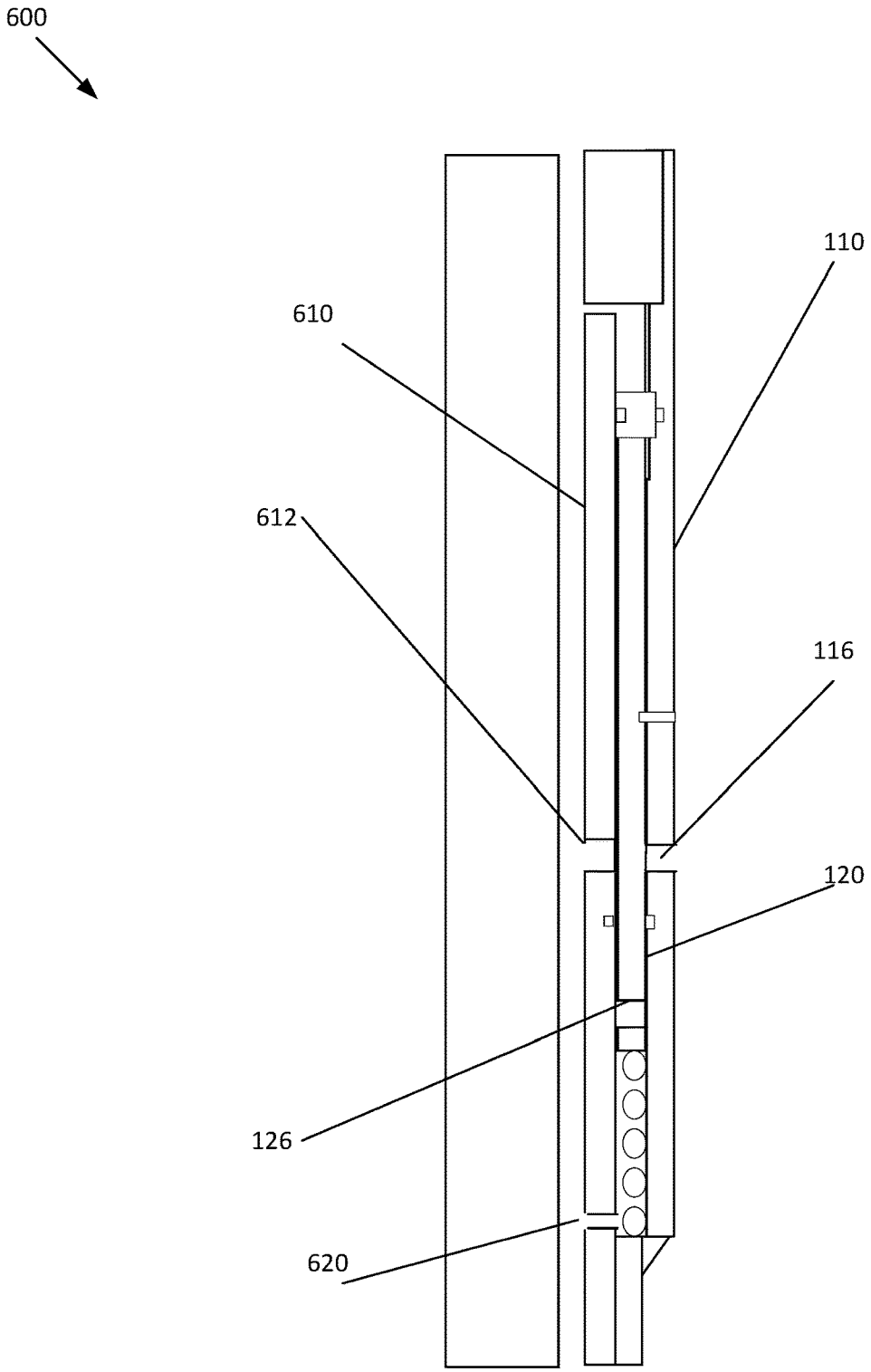
FIG. 6 depicts a downhole tool, according to an embodiment.

FIG. 6 depicts a tool 600, according to an embodiment. Elements depicted in FIG. 6 may be described above, and for the sake of brevity another description of these elements may be omitted.

Tool 600 may include an inner sidewall 610, wherein sliding sleeve 120 may be positioned between inner sidewall 610 and outer sidewall 110. By positioning sliding sleeve 120 between inner sidewall 610 and outer sidewall 110 a pressure differential across rupture disc 126 may remain constant until rupture disc 126 is aligned with, and exposed to, internal sidewall port 630 and external port 116. This may be due to the surfaces of sliding sleeve 120 and outer sidewall 110 being positioned adjacent to the surfaces of rupture disc 126 to limit the pressure applied to these surfaces of rupture disc 126.

Inner sidewall 610 may include a first passageway 612, a pressure equalizing port 620, and an internal sidewall port 630. The movement of sliding sleeve 120. Pressure equalizing port 620 may extend through inner sidewall 610 into a chamber housing force generating device 130 and may be configured to be a metering device to limit, reduce, dampen, etc. Pressure equalizing port 620 may also equalize the pressure between the inner diameter of tool 600 and the chamber housing force generating device 130. By equalizing the pressure as the pressure within the inner diameter is being reduce, the speed at which sliding sleeve 120 moves in the second direction may be dampened.

Figure 7:
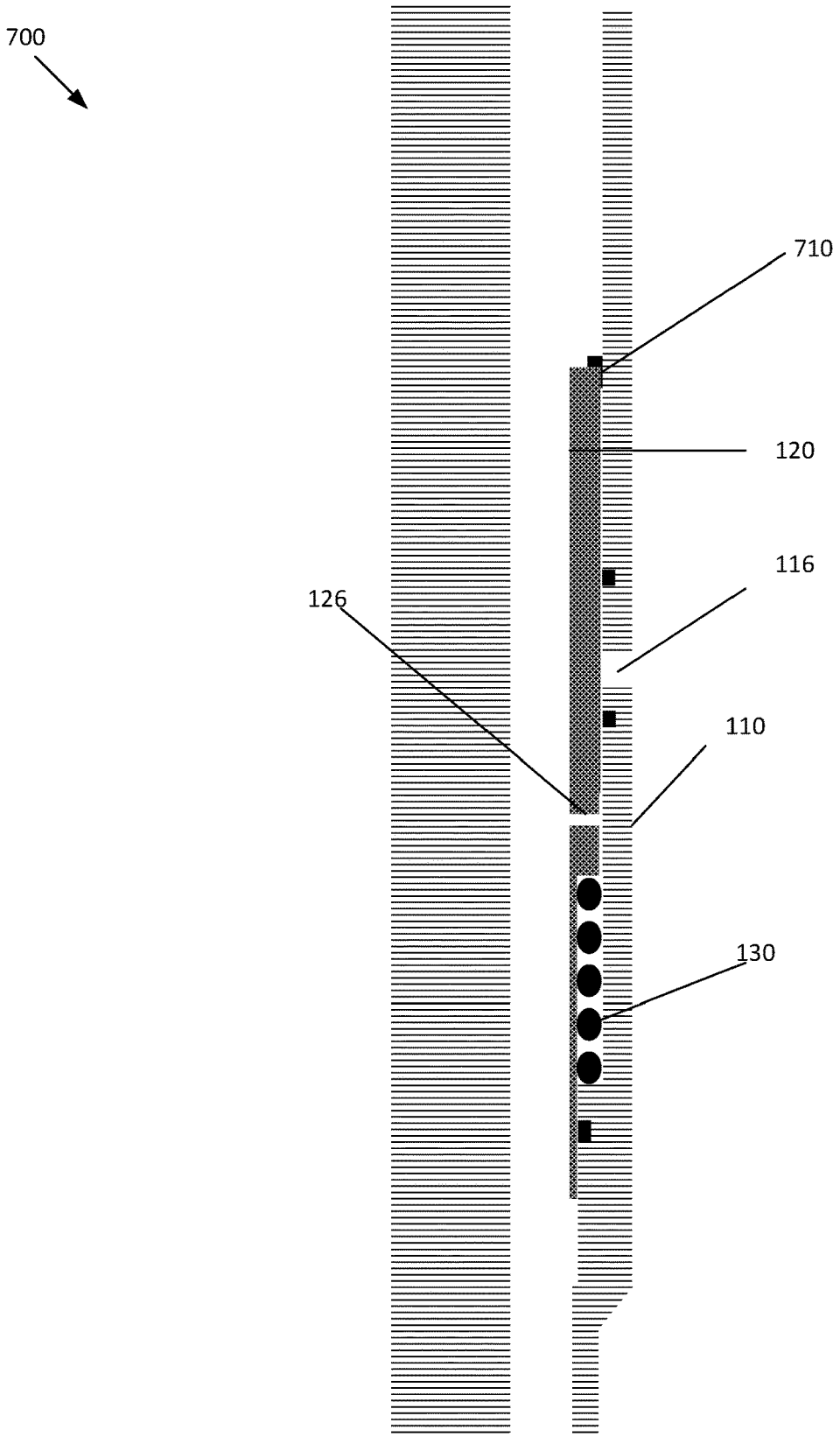
FIG. 7 depicts a downhole tool, according to an embodiment.

FIG. 7 depicts a tool 700, according to an embodiment. Elements depicted in FIG. 7 may be described above, and for the sake of brevity another description of these elements may be omitted.

As depicted in FIG. 7, a dissolvable shear ring 710, or any other object, profile, stop, geometry, including pins, screws, bolts, etc. (referred to hereinafter collectively and individually as "shear ring") may be positioned on a proximal end of sliding sleeve 120 to limit the movement of sliding sleeve 120. The dissolvable shear ring 710 may be configured to secure sliding sleeve 120 to casing 110 at a predetermined location, which may also secure force generating device 130 in a compressed position. Responsive to exposing dissolvable shear ring 710 to well bore fluid, dissolvable shear ring 710 may begin dissolving. After a predetermined amount of time of the dissolvable shear ring 710 being exposed to the wellbore conditions or due to timing, dissolvable shear ring may no longer couple sliding sleeve 120 to casing at the predetermined location. As such, after the predetermined amount of time, force generating device 130 may elongated, to align the inner port 126 and outer port 116.

However, in a time period from when the dissolvable shear ring 710 is exposed to the wellbore fluid, various testing to casing 110 may occur. For example, tool 700 may be run in hole, cemented, and pressure testing may occur during the predetermined amount of time.

Figure 8:
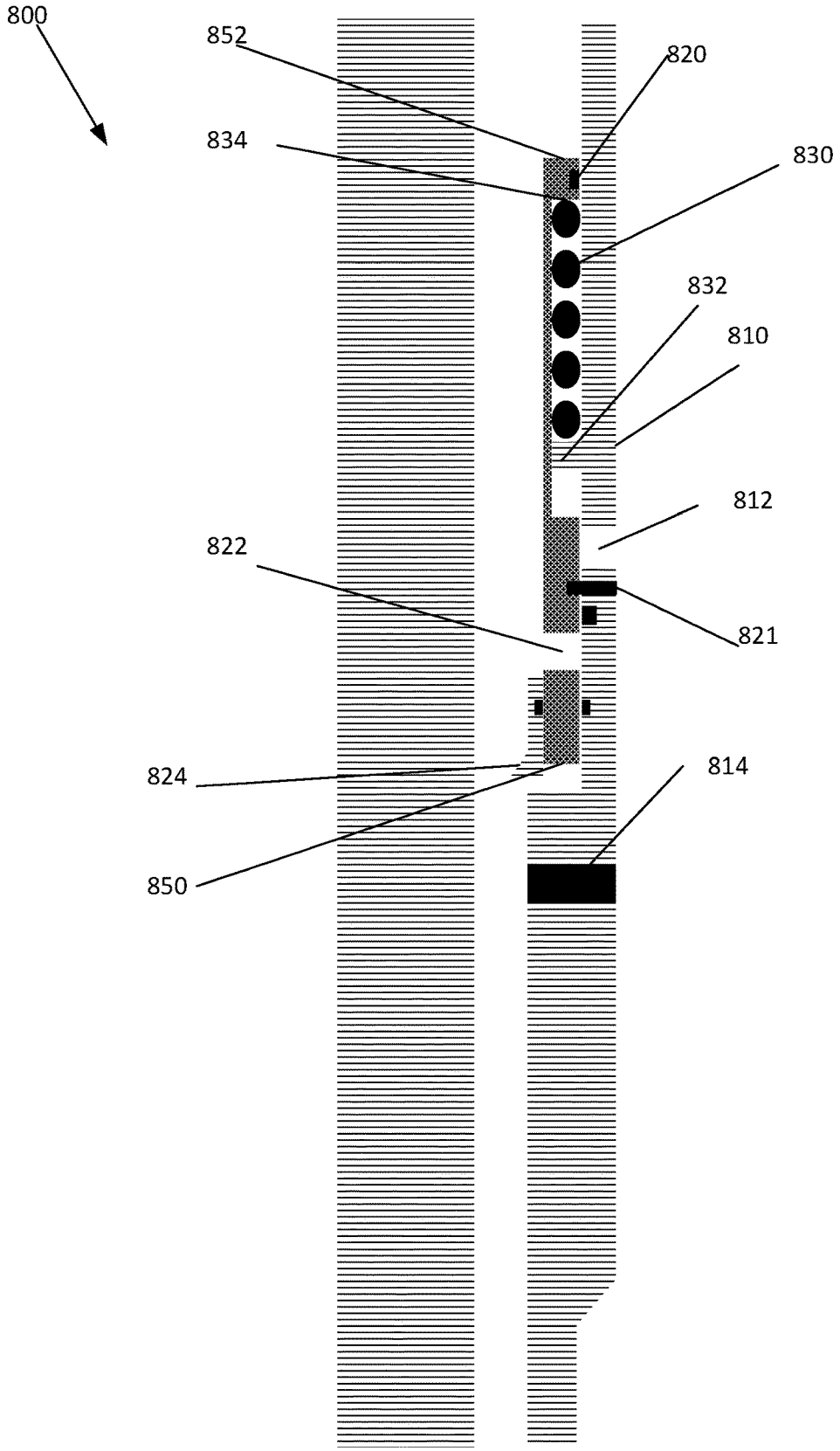
FIG. 8 depicts a downhole tool, according to an embodiment.

FIG. 8 depicts a tool 800, according to an embodiment. Elements depicted in FIG. 8 may be described above, and for the sake of brevity another description of these elements may be omitted. Tool 800 may include casing 810, sliding sleeve 820, force generating device 830, and burst disc 840.

Casing 810 may include an external port 812 and through port 814 that are configured to extend through casing 810. External port 812 may include a first burst disc that is configured to be removable during a bleed of a cycle. In embodiments, external port 812 may be covered by sliding sleeve 820 in a first mode, and external port 812 may be aligned with an internal port 822 within sliding sleeve 820 in a second mode. Through port 814 may be configured to be positioned through casing 810. Through port 814 may be positioned below a distal end of sliding sleeve 820. In embodiments, through port 814 may have a larger diameter than external port, and may include a second burst disc. The second burst disc may be configured to rupture based on a pressure differential across the second burst disc or after a predetermined amount of time. In embodiments, a shear screw 821, or other coupling mechanism may be configured to temporarily couple casing 810 and sliding sleeve 820. Responsive to a pressure differential between the inner diameter of tool 800 and an annulus outside of casing 810 being above a predetermined threshold, the shear screw 821 may break. This may allow for the axial movement of sliding sleeve 820 within casing 810.

Sliding sleeve 820 may be positioned on an inner diameter of casing 110, and may be configured to slide axially within casing 110. Sliding sleeve 820 may slide within casing 110 based on forces received from force generating device 130 and pressure within an inner diameter of casing 110.

Sliding sleeve 820 may have an internal port 822, seat 824, and piston 850, 852. Internal port 822 may extend through sliding sleeve 820. Internal port 822 may be configured to align with external port 812 in the second mode, and be misaligned with external port 812 in the first mode. In the second mode, an annulus between casing 810 and the inner diameter of tool 800 may be in communication to have an equalized pressure. A proximal end of sliding sleeve 120 may have a first piston area 850, and a distal end of sliding sleeve 120 may have a second piston area 852, wherein first piston area 850 and second piston area 852 may be balanced.

Seat 824 may be positioned on an inner diameter of sliding sleeve 120, reduce the inner diameter across tool 800, and may be configured to receive a ball, or any other object, dropped within the inner diameter of tool 800. Responsive to positioning a ball or any other object on seat 824, a piston area on the distal end of sliding sleeve 120 may be greater than that on the proximal end of sliding sleeve 120, which may allow sliding sleeve 120 to move axially within casing 810. In embodiments, seat 824 may be an expandable seat with a variable inner diameter. In the first mode, the inner diameter of seat 824 may have a first diameter that is smaller than that of the ball. In the second mode, the inner diameter of seat 824 may expand to a second diameter, which is great than that of the ball. This may allow the ball to pass through seat 824 when in the second mode.

Force generating device 830 may be a device that is configured to apply an axial force against sliding sleeve 820. Force generating device may be positioned between a projection 832 extending from casing 810 towards a central axis of tool, and a shelf 834 positioned on seat 824. In embodiments, force generating device 830 may be configured to rest on projection 832 and apply an expansive force towards the proximal end of sliding sleeve responsive to shear screw 821 breaking.

Accordingly, tool 800 may allow a burst disc 814 to be directly mounted in the casing 810. At a first pressure cycle, the casing 810 may be partially tested for cracks, leaks, etc. Responsive to increasing the pressure within the inner diameter of tool 810, burst disc 814 may be dissolved, shear, etc. and allow communication between the annulus and inner diameter of tool 800 at a location below seat 824.

Responsive to a ball being positioned on seat 824, the inner diameter of tool 800 may be partitioned into multiple zones, a first zone positioned between the ball and a proximal end of tool 800 and a second zone positioned between the ball and a distal end of tool 800. In embodiments, the second zone may be in communication with the annulus via the port that previously held burst disc 814. Once the ball is positioned on seat 824, pressure within the first zone may be increased, shearing shear screw 821 and allowing force generating device 830 to compress and move sliding sleeve 820 towards the distal end of tool 800. This may allow the casing to be tested. Responsive to bleeding off the pressure in the first zone, pressures in the first zone and the second zone may be equal, where the only net force applied to sliding sleeve 120 being received from force generating device 830. This may cause sliding sleeve 820 to move to the second mode, where external port 812 and internal port 822 are aligned.

Figure 9:
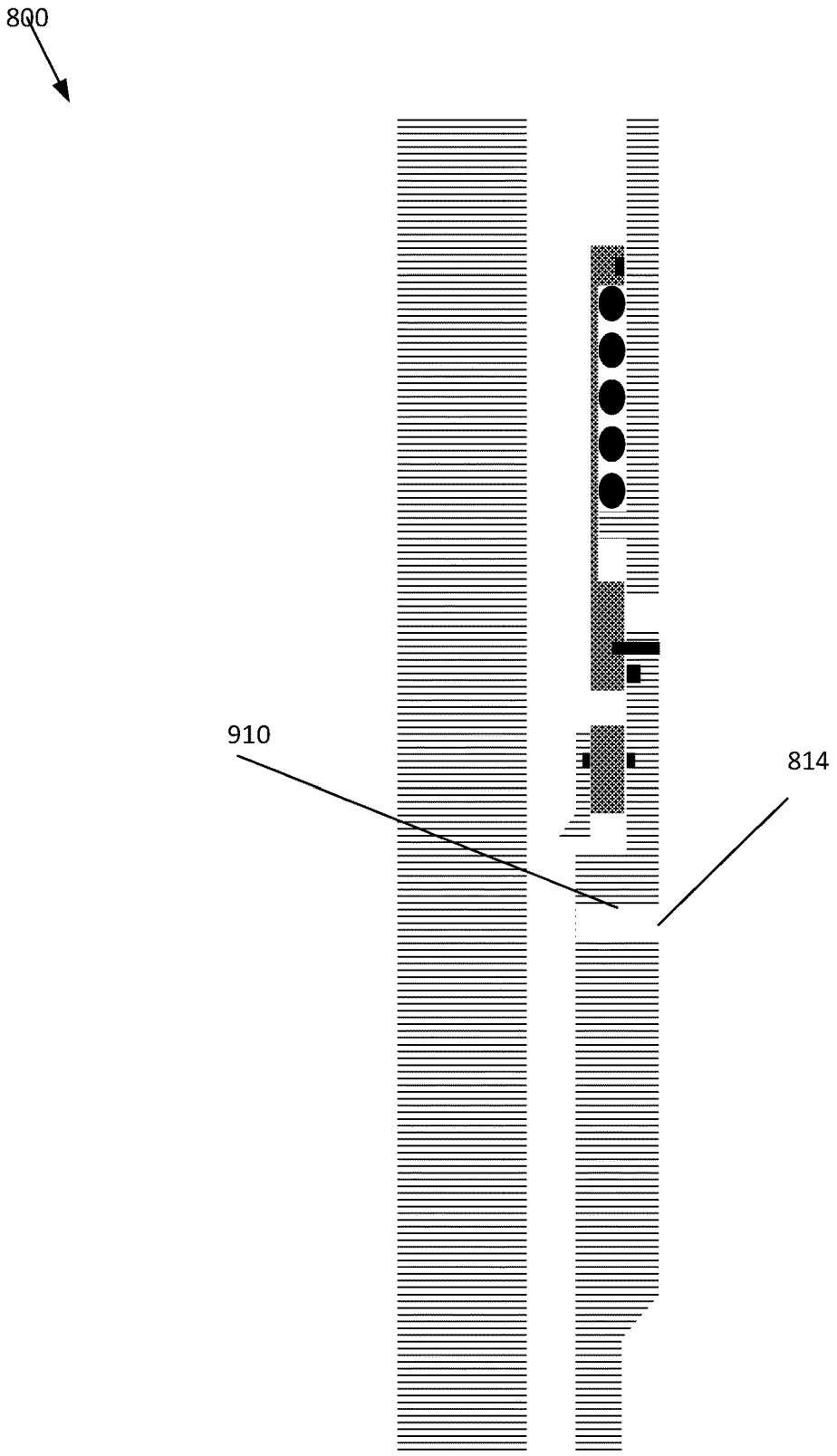
FIG. 9 depicts a downhole tool, according to an embodiment.

FIG. 9 depicts a tool 800, according to an embodiment. Elements depicted in FIG. 9 may be described above, and for the sake of brevity another description of these elements may be omitted.

As depicted in FIG. 9, after a predetermined amount of time or creating a pressure differential across burst disc 814, burst disc 814 may be removed. This may expose lower port 910 positioned below sliding sleeve 120.

Figure 10:
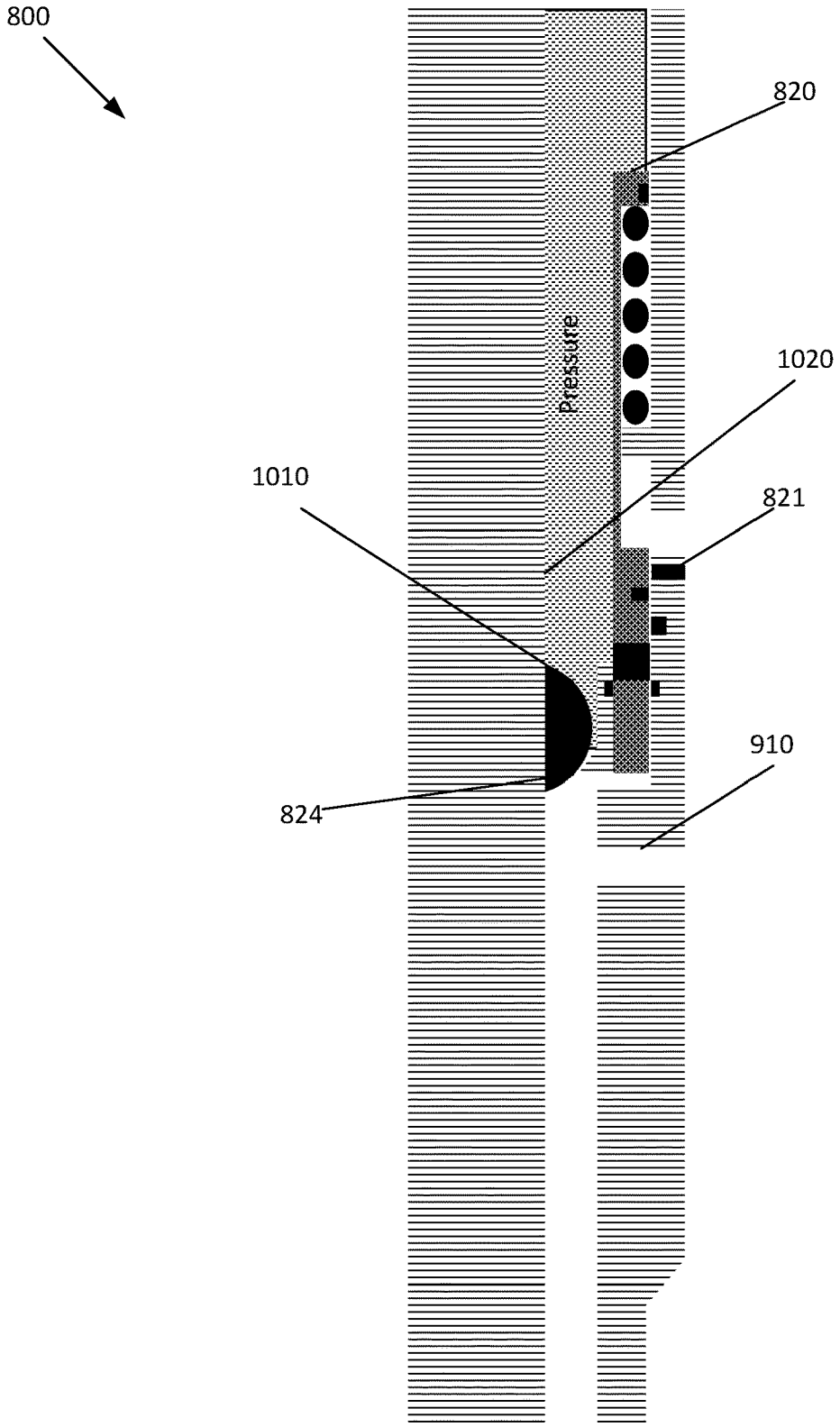
FIG. 10 depicts a downhole tool, according to an embodiment.

FIG. 10 depicts a tool 800, according to an embodiment. Elements depicted in FIG. 10 may be described above, and for the sake of brevity another description of these elements may be omitted.

As depicted in FIG. 10, a ball 1010 may be positioned on seat 824 and fluid may flow through the inner diameter of tool 800 above ball 1010, and partition the inner diameter into two zones. A first zone may be positioned above ball 1010, and a second zone may be positioned below ball 1010. Ball 1010 isolating the first zone from the second zone may allow the pressure acting upon sliding sleeve 820 towards the distal end of tool 800 to increase, which may break shear screw 821. Responsive to shear screw 821 breaking, sliding sleeve 820 may move towards the distal end of tool 800, and allow for the testing of casing.

Figure 11:
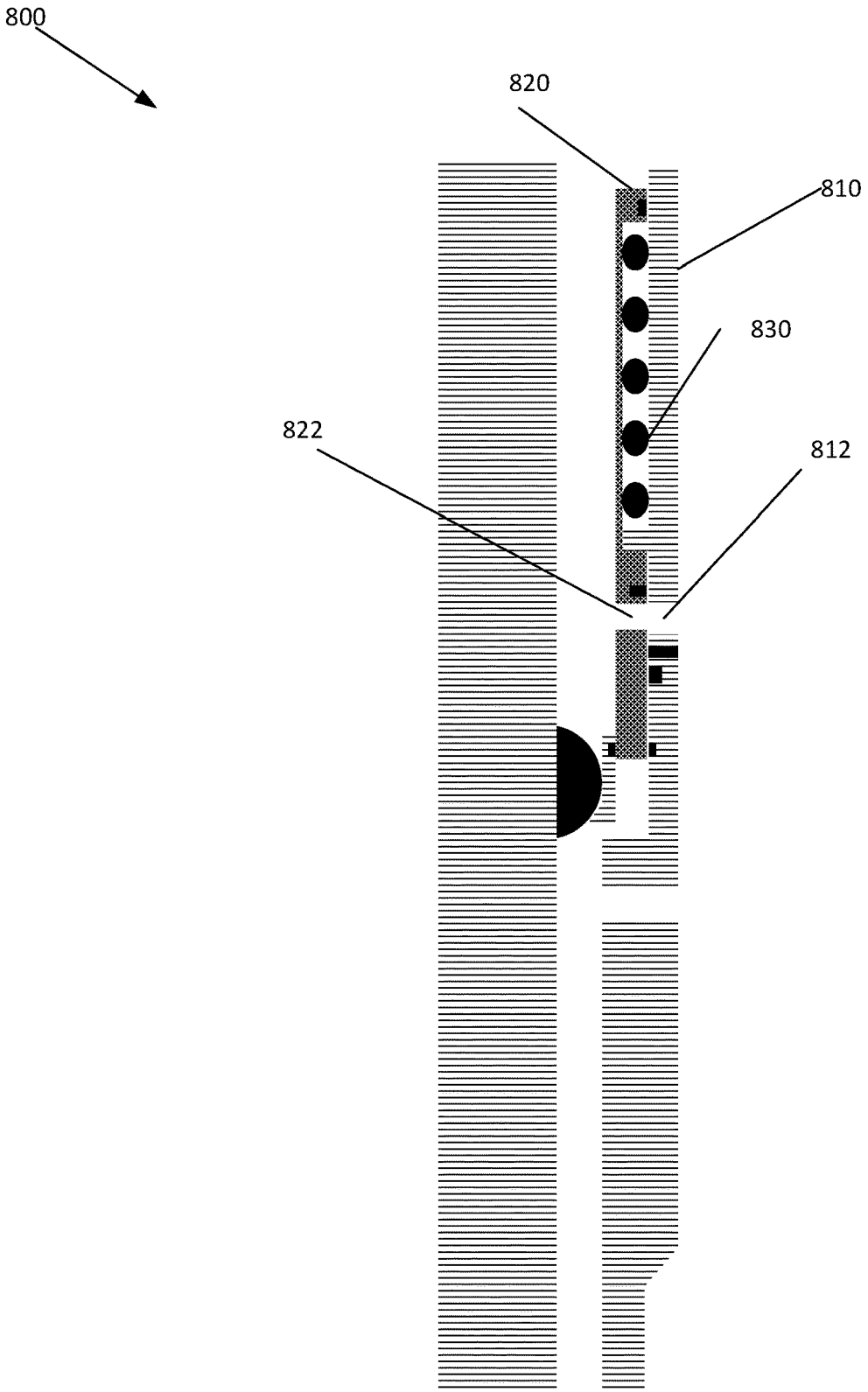
FIG. 11 depicts a downhole tool, according to an embodiment.

FIG. 11 depicts a tool 800, according to an embodiment. Elements depicted in FIG. 11 may be described above, and for the sake of brevity another description of these elements may be omitted.

As depicted in FIG. 11, responsive to bleeding off the pressure in tool 800, f the pressure in the first zone and the second zone acting upon sliding sleeve 820 may equalize allowing force generating device 830 to contract. This may cause sliding sleeve 820 to move towards the proximal end of tool 800, which may align internal port 822 and external port 812.

Figure 12:
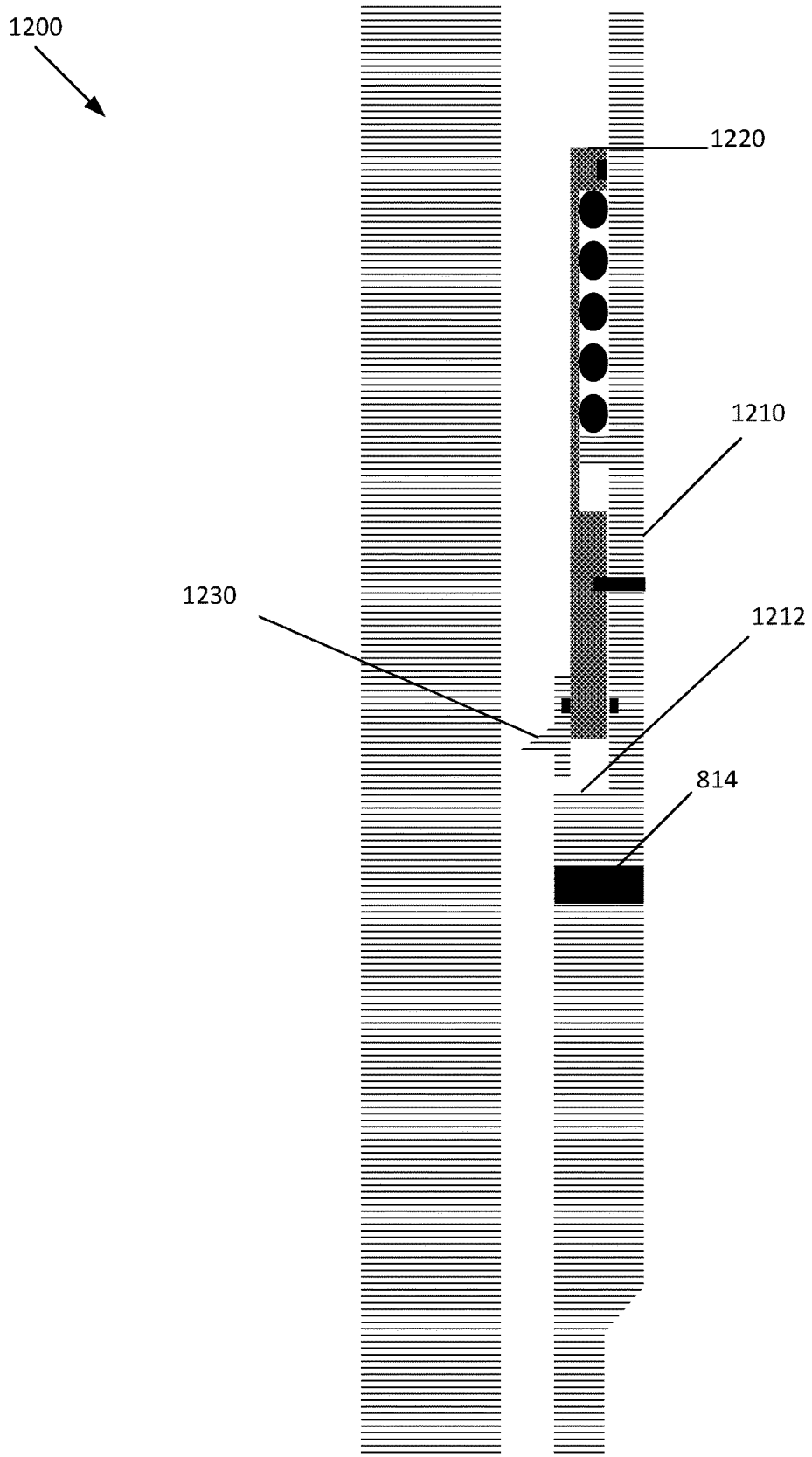
FIG. 12 depicts a downhole tool, according to an embodiment.

FIG. 12 depicts a tool 1200, according to an embodiment. Elements depicted in FIG. 12 may be described above, and for the sake of brevity another description of these elements may be omitted.

As depicted in FIG. 12, neither sliding sleeve 1220 nor casing 1210 may include an exterior port or an exterior port. However, there may be a recess 1212 between sliding sleeve 1220 and casing 1210, wherein ball seat 1230 may expand into when sliding sleeve 1220 is in the second mode. This may allow for communication between the inner diameter of tool 1200 and an annulus at a position below sliding sleeve 1220.

Further rupture disc 810 may not be broken when being run in the well. This may allow a balanced piston between a proximal end of sliding sleeve 1220 and a distal end of sliding sleeve positioned in recess 1212.

Figure 13:
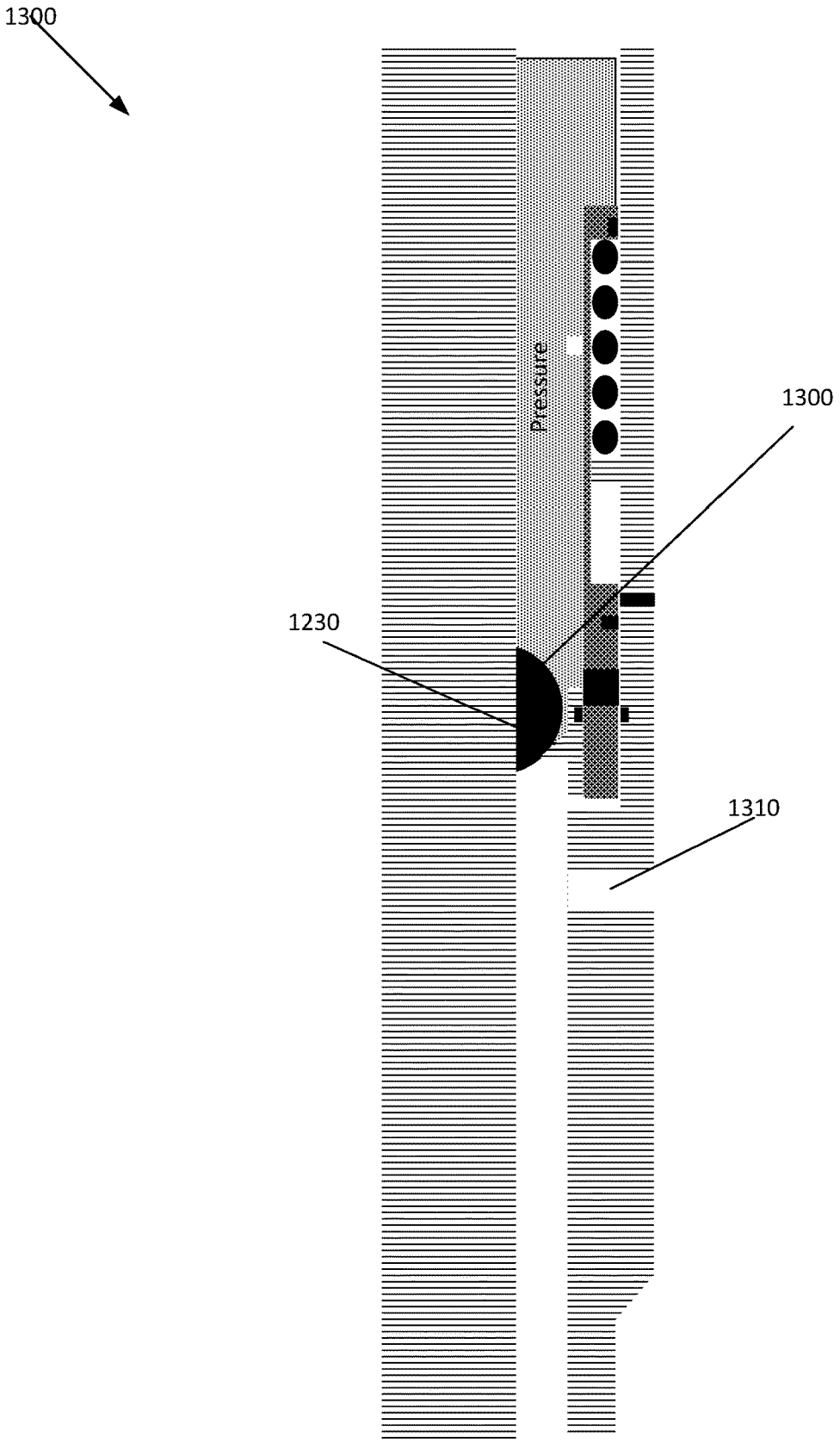
FIG. 13 depicts a downhole tool, according to an embodiment.

FIG. 13 depicts a tool 1200, according to an embodiment. Elements depicted in FIG. 13 may be described above, and for the sake of brevity another description of these elements may be omitted.

As depicted in FIG. 13, the disc may have been ruptured exposing port 1310 that extends through the casing 1210 at a location below expandable ball seat 1230.

Responsive to positioning a ball 1230 on expandable seat 1230, sliding sleeve 1210 may move towards the distal end of tool 1200, while expandable seat 1230 remains axially static within tool 1200. As there are no ports through sliding sleeve 1220 or casing 1210, casing 1210 may be pressurized as long as desired.

Figure 14:
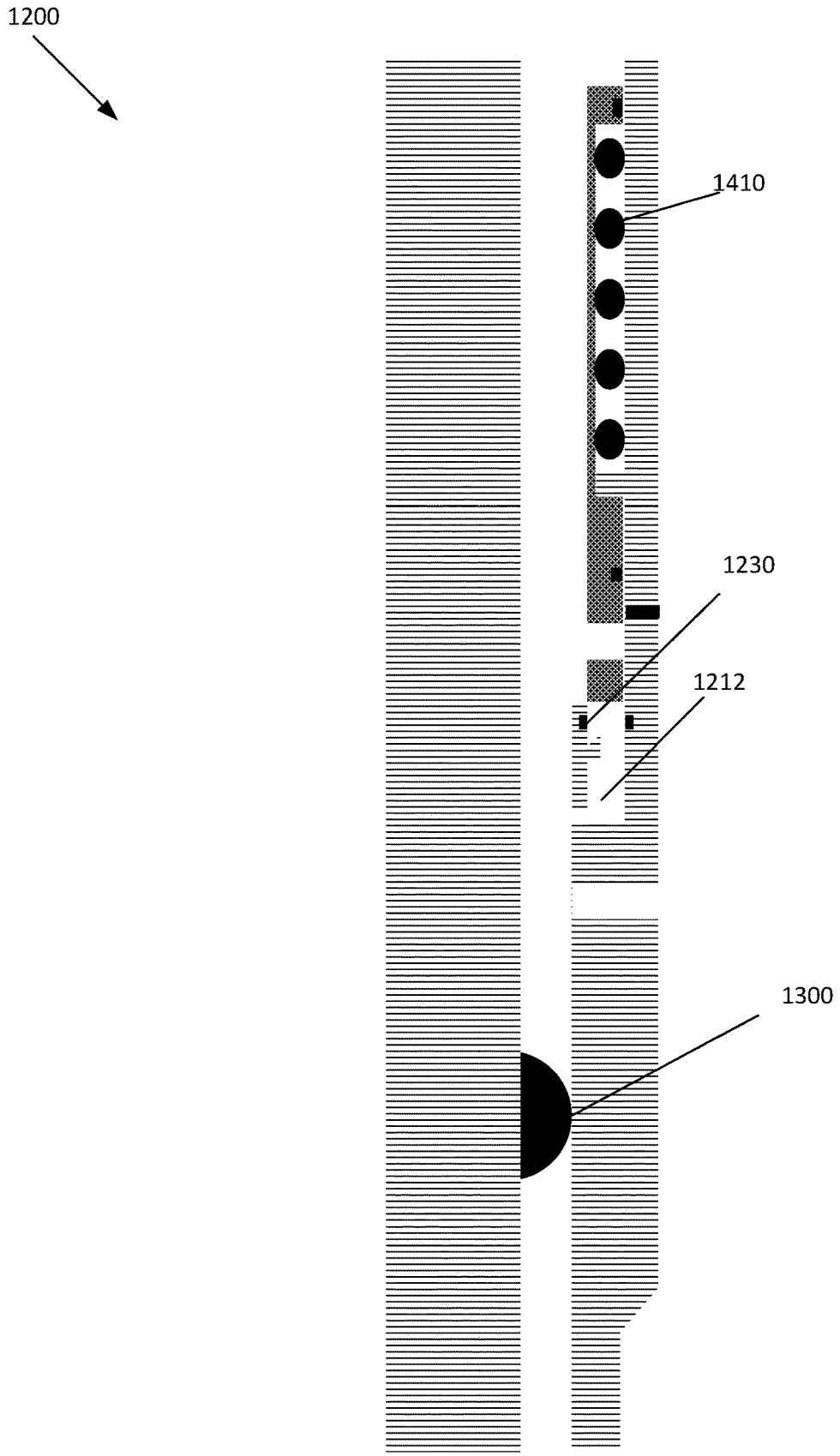
FIG. 14 depicts a downhole tool, according to an embodiment.

FIG. 14 depicts a tool 1200, according to an embodiment. Elements depicted in FIG. 14 may be described above, and for the sake of brevity another description of these elements may be omitted.

As depicted in FIG. 14, responsive to bleeding pressure off ball 1300, force generating device 1410 may compress moving sliding sleeve 1220 towards the proximal end of tool 1200. This may expose recess 1212 to expandable seat 1230, and allow expandable seat 1230 to move radially within recess 1212, and increase the inner diameter of expandable seat 1230 to a length that is greater than the diameter of ball 1300. When the size of the inner diameter of expandable seat 1230 is greater than than that of ball 1300, ball 1300 may move towards the distal end of tool 1200, which may allow communication through the inner diameter of tool through port 1310.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

The invention claimed is:

1. A method associated with a toe sleeve comprising:

positioning a rupture disc within a sleeve port positioned through an inner sleeve;

equalizing pressure across the rupture disc in a first mode via an equalizing port, wherein in the first mode the sleeve port is misaligned with a sidewall port;

creating a pressure differential across the rupture disc in a second mode, wherein in the second mode the sleeve port is aligned with the sidewall port; and forming a first piston area on a proximal end of the inner sleeve, the first piston area being a first total surface area impacting a downhole movement of the first sleeve;

forming a second piston area on a distal end of the inner sleeve, the second piston area being a second total surface area impacting an up hole movement of the second sleeve, the first piston area being larger than the second piston area.

2. The method of claim 1, wherein the second piston area includes a first surface area and a second surface area, the first surface area and the second surface area being offset from each other.

3. The method of claim 2, further comprising:

positioning a force generating device within a chamber, wherein the chamber is in communication with an inner diameter of the toe sleeve, a distal end of the force generating device being positioned between the first surface area and the second surface area.

4. The method of claim 3, wherein a seal is positioned between the first surface area and the second surface area.

5. The method of claim 1, further comprising:

positioning locking fingers associated with the inner sleeve adjacent to locking joints associated with the outer sidewall to limit the axial movement of the inner sleeve.

6. The method of claim 2, further comprising:

aligning locking fingers associated with the inner sleeve and the first total surface area with a recess positioned in the outer sidewall to limit an impact of a piston area on a proximal end of the inner sleeve, the locking fingers being positioned on a proximal end of the inner sleeve.

7. The method of claim 6, wherein the recess has a larger diameter than the proximal end of the sliding sleeve, and the locking fingers are configured to be positioned within the recess to limit the downhole movement of the inner sleeve.

8. The method of claim 1, wherein the equalizing port extends through the inner sleeve.

9. The method of claim 1, wherein a first surface of the rupture disc is configured to face a central axis, and a second face of the rupture disc is configured to face an inner circumference of the outer sidewall.

10. The method of claim 1, further comprising:

positioning the inner sleeve port between seals in the second mode; and positioning the inner sleeve port outside of the seals in the first mode.

11. A system associated with a toe sleeve comprising:

a rupture disc positioning within a sleeve port, wherein the sleeve port extends through a sliding sleeve;

an equalizing port extending through the sliding sleeve, the equalizing port being configured to equalize a pressure across the rupture disc in a first mode and allow for a pressure differential across the rupture disc in a second mode, wherein in the first mode the sleeve port is misaligned with a sidewall port, wherein in the second mode the sleeve port is aligned with the sidewall port;

a first piston area on a proximal end of the inner sleeve, the first piston area being a first total surface area impacting a downhole movement of the first sleeve;

a second piston area on a distal end of the inner sleeve, the second piston area being a second total surface area impacting an up hole movement of the second sleeve, the first piston area being larger than the second piston area.

12. The system of claim 11, wherein the second piston area includes a first surface area and a second surface area, the first surface area and the second surface area being offset from each other.

13. The system of claim 12, further comprising:

a force generating device within a chamber, the force generating device being configured to move the sliding sleeve, wherein the chamber is in communication with an inner diameter of the toe sleeve, a distal end of the force generating device being positioned between the first surface area and the second surface area.

14. The system of claim 13, wherein a seal is positioned between the first surface area and the second surface area.

15. The system of claim 11, further comprising:

locking fingers associated with the sliding sleeve configured to be positioned adjacent to locking joints associated with the outer sidewall to limit the axial movement of the sliding sleeve.

16. The system of claim 12, further comprising:

a recess positioned in the outer sidewall, wherein locking fingers associated with the inner sleeve and the first total surface area are configured to move to be aligned with the recess to limit an impact of a piston area on a proximal end of the inner sleeve, the locking fingers being positioned on a proximal end of the inner sleeve.

17. The system of claim 16, wherein the recess has a larger diameter than the proximal end of the sliding sleeve, and the locking fingers are configured to be positioned within the recess to limit the downhole movement of the inner sleeve.

18. The system of claim 11, wherein the equalizing port extends through the sliding sleeve.

19. The system of claim 11, wherein a first surface of the rupture disc is configured to face a central axis, and a second face of the rupture disc is configured to face an inner circumference of the outer sidewall.

20. The system of claim 11, further comprising:

a pair of seals, wherein the sleeve port is configured to be positioned between the pair of seals in the second mode and outside of the pair of seals in the first mode.

* * * * *